United States Patent [19]

Jaquay

[11] 4,249,722

[45] Feb. 10, 1981

[54] APPARATUS FOR THE FLASH OXIDATION OF METAL CONCENTRATES

[75] Inventor: Louis H. Jaquay, Pittsburgh, Pa.

[73] Assignee: Dravo Corporation, Pittsburgh, Pa.

[21] Appl. No.: 38,322

[22] Filed: May 11, 1979

[51] Int. Cl.[3] ..... C22B 1/10

[52] U.S. Cl. ..... 266/172; 266/176; 266/188; 75/9

[58] Field of Search ..... 266/172, 188, 176; 75/9

[56] References Cited

U.S. PATENT DOCUMENTS

| | | | |
|---|---|---|---|
| 1,073,462 | 9/1913 | Banes | 266/182 X |
| 1,073,463 | 9/1913 | Banes | 266/172 |
| 1,163,650 | 12/1915 | Fogler | 110/264 |
| 1,315,460 | 9/1919 | Blackwell et al. | 75/68 P |
| 1,888,164 | 11/1932 | Freeman | 75/77 X |
| 3,459,415 | 8/1969 | Holeczy et al. | 266/11 |
| 3,463,472 | 8/1969 | Worner | 266/11 |
| 3,889,933 | 6/1975 | Jacquay | 266/34 L |
| 4,102,676 | 7/1978 | Jacquay | 75/77 |
| 4,147,535 | 4/1979 | Lilja et al. | 266/172 X |

*Primary Examiner*—G. Ozaki

*Attorney, Agent, or Firm*—Parmelee, Miller, Welsh & Kratz

[57] ABSTRACT

A burner for the flash oxidation of particles of metal concentrates has three downwardly directed, concentrically mounted tubes each having a venturi nozzle on the discharge end thereof. Finely divided metal concentrates introduced into the annular space between the inner tube and the intermediate tube are accelerated by high pressure oxygen introduced through the inner tube to substantially the velocity of an oxidizing gas introduced into the annular space between the intermediate tube and the outer tube. Means are provided for adjusting the extent that the nozzles on the ends of the inner tube and intermediate tube extend into the nozzles on the ends of the intermediate and outer tubes respectively.

5 Claims, 1 Drawing Figure

APPARATUS FOR THE FLASH OXIDATION OF METAL CONCENTRATES

BACKGROUND OF THE INVENTION

1. Field of the Invention

This invention relates to the oxidation of finely divided metal concentrates by injecting them into a heated enclosure in a flow of air and oxygen.

2. Prior Art

It is known to smelt sulfide ores of copper and lead by injecting the finely divided ore downward into a furnace with air as disclosed in U.S. Pat. No. 1,888,164. It is also known to inject the ores downward into the furnace through a tube concentrically mounted inside an outer tube carrying pressurized oxygen gas as taught by U.S. Pat. No. 3,459,415. In this latter arrangement, the discharge end of the central ore carrying tube extends axially partially into a nozzle mounted on the end of the outer tube. The flow of pressurized oxygen through the nozzle in the outer tube draws the ore concentrate from the inner tube.

U.S. Pat. No. 1,073,462 discloses a burner for making sublimed white lead having three concentric pipes each with a nozzle at the end thereof. Ore concentrates, together with air, are introduced into the inner tube. A rotating rifle grooved spindle swirls the mixture of air and ore concentrates as it is directed toward the nozzle of the intermediate tube. A gaseous fuel introduced through the intermediate tube and air introduced through the outer tube produce a flame which establishes the conditions necessary for the oxidation of the ore concentrates.

One difficulty with the prior art burners used with these ore conversion processes is that splatterings from the furnace can plug the end of the burner and raise the danger that the flaming gases will backup through the ore concentrate supply line and cause fire or severe damage.

It is a primary object of the present invention to provide a burner for use in the flash oxidation of ore concentrates which minimizes the possibility of flashback through the ore concentrate line.

It is also a primary object of the invention to provide such a burner which is efficient, economical and reliable.

It is another object of the invention to provide such a burner which minimizes the amount of high pressure oxygen required to carry out the flash oxidation process.

SUMMARY OF THE INVENTION

According to the invention, a burner for use in the flash oxidation of ore concentrates comprises three concentric tubes, each having a nozzle in the end thereof. The intermediate tube, through which the finely divided ore concentrates are introduced, is axially aligned with the outer tube, through which an oxidizing gas is introduced under pressure, such that the nozzle on the end of the intermediate tube extends partially into the nozzle on the end of the outer tube. The inner tube, through which an additional oxidizing gas, preferably oxygen, is introduced at a pressure substantially above that of the oxidizing gas, is axially aligned with its nozzle extending partially into the nozzle on the end of the intermediate tube. With this arrangement, the ore concentrate fed through the intermediate tube is injected into the oxidizing gas at high velocity by the high pressure oxygen supplied by the inner tube. This arrangement not only achieves good mixing of the oxidizing gas with the concentrates which promotes efficient operation, but it also minimizes the dangers accompanying plugging of the end of the burner which might result from splattering in the furnace. Since the ore concentrates are being injected into the nozzle of the outer tube by high pressure oxygen from the inner tube, the oxidizing gas cannot backup through the ore feed pipe to create a fire hazard. Instead, the high pressure oxygen from the inner tube will backup through the outer tube and be relieved by the pressure relief valve of the oxidizing gas line. Since back pressure will be created at the nozzle of the intermediate tube under these conditions, feeding of the ore concentrate will cease.

The burner is mounted with the concentric tubes directed vertically downward into a refractory lined chamber. Preferably, means are provided for axial alignment of the intermediate tube in the outer tube to adjust the extent that the nozzle on the end of the intermediate tube extends into the nozzle of the outer tube. Likewise, it is preferred that means be provided for similar axial adjustment of the inner tube within the intermediate tube. Such means allow for adjustment of the mixture of ore concentrates and oxidizing gas and adjustment of conditions to achieve through mixing of the constituents. Also, preferably, the outer tube is surrounded by a jacket through which a fluid coolant can be circulated to cool the burner. The pressure at which the additional oxidizing gas is introduced into the inner tube should be sufficiently above that at which the oxidizing gas is introduced into the outer tube, such that the particles of ore concentrate are accelerated to substantially the velocity of the gas introduced through the outer tube.

BRIEF DESCRIPTION OF THE DRAWING

The FIGURE is a vertical sectional view of a burner made in accordance with the invention.

DESCRIPTION OF THE PREFERRED EMBODIMENT

Figure 1:
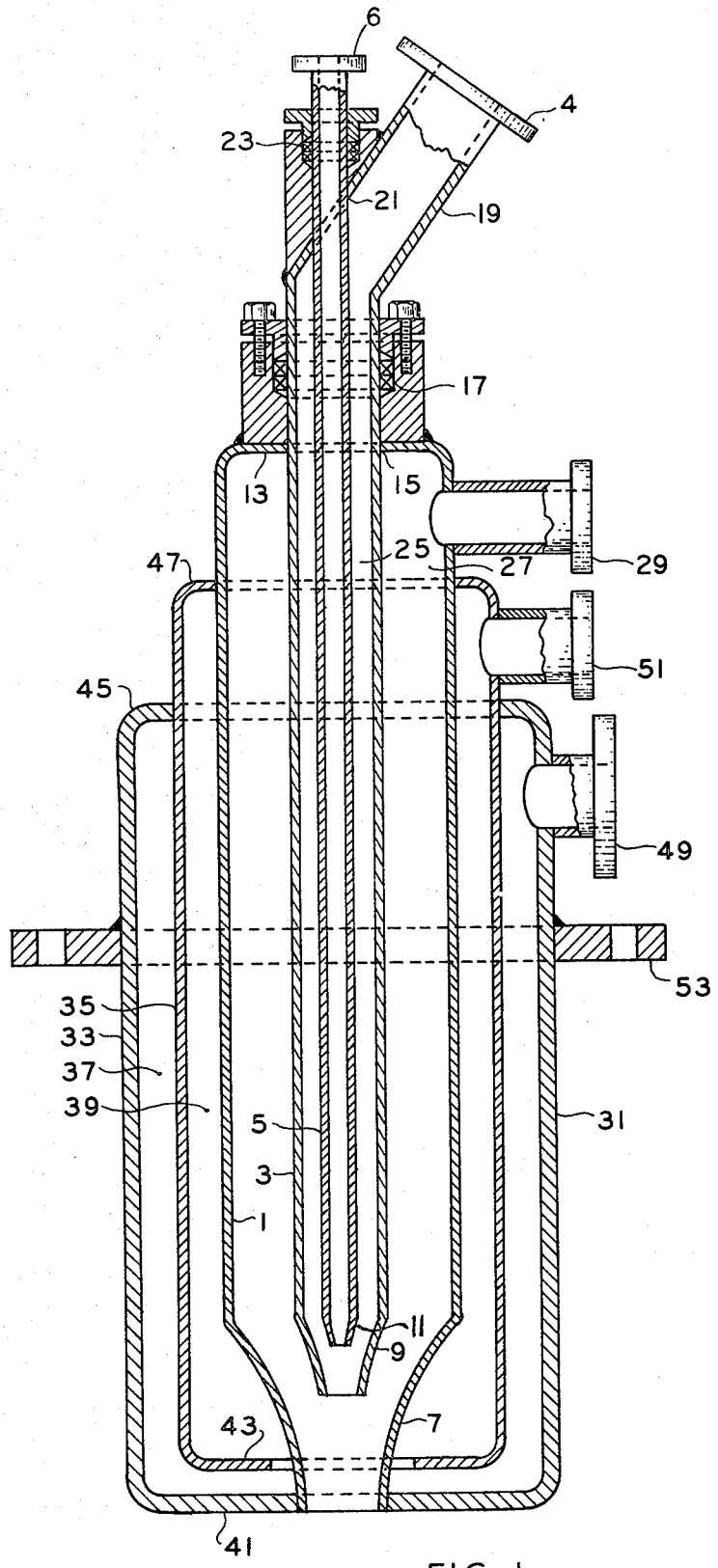

As shown in the Figure, a burner in accordance with this invention comprises three concentric tubes 1, 3 and 5, each provided with a nozzle 7, 9 and 11 respectively at the discharge end thereof. The outer tube 1 has a flange 13 on the upper end provided with a bore 15 through which the intermediate tube 3 is inserted. A packing gland 17 permits axial adjustment of the position of the intermediate tube inside the outer tube to adjust the extent that the nozzle 9 on the end of the intermediate tube 3 extends into the nozzle 7 on the end of the outer tube.

The intermediate tube 3 terminates at its upper end in a section 19 which extends diagonally outward from the tube axis. A bore 21 in this diagonal section, which is aligned with the longitudinal axis of the tube 3, permits the inner tube to be axially inserted within the intermediate tube. Another packing gland 23 permits axial adjustment of the inner tube 5 within the intermediate tube 3 to adjust the extent to which the nozzle 11 on the end of the inner tube extends into the nozzle 9 of the intermediate tube.

In operation, high pressure oxygen is introduced through inlet means 6 on the upper end of the inner tube 5 and is ejected at high velocity into the nozzle 9 of the intermediate tube 3 by the nozzle 11 on the lower end of the inner tube. The finely divided ore concentrates to be processed are introduced through inlet means 4 into the diagonal section 19 of the intermediate tube from which they pass downward through the annular space 25 between the inner and intermediate tubes 5 and 3, respectively, and out through the nozzle 9. The high pressure oxygen passing through the nozzle 9 sucks the ore concentrates out of the annular chamber 25 and injects them at high velocity into the nozzle 7 on the end of the outer tube 1. The nozzle 7 mixes the high velocity ore concentrate particles with an oxidizing gas, such as air or oxygen-enriched air, which is introduced into the annular space 27 between the intermediate and outer tubes 1 and 3, respectively, through inlet means 29 on the side of the outer tube. The mixture emitted from the nozzle 7 is ignited to carry out the oxidation process.

The injection of the ore concentrates into the flow of oxidizing gas by the jet of high pressure oxygen and the arrangement of the successive nozzles promotes good dispersion of the ore concentrate particles and their thorough mixing with the oxidizing gases so that complete oxidation of the ore concentrates takes place in a very short distance from the nozzle 7. This provides more efficient and complete oxidation of the ore concentrates and permits the process to be carried out in a smaller chamber than has heretofore been used for such processes.

Since the intense mixing of the oxidizing gas and the ore concentrates is achieved by accelerating the oxidizing gas by forcing it through the venturi of nozzle 7, it is important that the jet of high pressure oxygen impart sufficient velocity to the ore concentrates such that the gas velocity does not decrease and pulsate in a series of slugs. Such pulsation would result in oxidizing gas pressure being developed in the ore concentrate feed tube 3 and could result in premature ignition of the ore concentrate. The packing glands 17 and 23 permit adjustments to be made in the axial alignment of the nozzles 7, 9 and 11 for more efficient operation of the burner.

Due to the high temperatures developed by the reactions carried out in the flame produced below the nozzle 7, the burner is provided with a cooling jacket 31 which surrounds the lower portion of the outer tube 1. The cooling jacket comprises two concentric tubes 33 and 35 which form annular chambers 37 and 39, respectively. A radial flange 41 on the lower end of the tube 33 closes the lower end of the cooling jacket. A second radial flange 43 on the lower end of the tube 35 only extend partially toward the inner tube 1 to allow fluid communication between the annular chambers 37 and 39. The upper ends of the chambers 37 and 39 are closed by radial flanges 45 and 47 on tubes 33 and 35, respectively. A cooling fluid such as water is introduced through an inlet 49 into the annular chamber 37 where it flows downward and then upward through annular chamber 39 and out through outlet 51.

Preferably, the burner is mounted in a furnace with the nozzles directed vertically downward. A flange 53 extending radially outward from the cooling jacket 31 below the cooling water inlet 49 permits the burner to be mounted in this manner.

Should splatterings from the furnace plug the opening in the nozzle 7, there is little danger of flashback or blow back to the ore concentrate delivery system through intermediate tube 3. In such an instance, the high pressure oxygen introduced by the inner tube 1 will backup through tube 1 and be relieved by the pressure relieve system normally provided in the oxidizing gas supply system.

The described burner is especially useful in smelting ores containing sulfides of copper and lead.

EXAMPLE

For carrying out the process of flash oxidation of copper concentrates, the following table illustrates the quantities of air and oxygen required for each pound of concentrate, depending upon the quality of the matte.

| Matte Grade (% Copper) | 45% | 50% | 55% | 60% | 65% |
|---|---|---|---|---|---|
| SCF Air/lb. Conc. | 0.8 | 4.3 | 6.4 | 8.2 | 9.8 |
| SCF $O_2$/lb. Conc. | 2.4 | 2.5 | 2.7 | 2.8 | 2.9 |
| Total Air and $O_2$/lb. of Conc. | 3.2 | 6.8 | 9.1 | 11.0 | 12.7 |

For processing to a 65% copper matte, a suitable burner in accordance with the invention would have a main nozzle 7 with a cross sectional area of 0.00545 square ft., a concentrate feed nozzle 9 with a cross sectional area of 0.00196 square ft. and a high pressure oxygen nozzle 11 with a cross sectional area of 0.000085 square ft. This burner would process 25.7 lbs. per minute of copper concentrate using 252 standard cubic feet per minute of air and 75 standard cubic feet per minute of oxygen and would generate a velocity at nozzle 7 of 1000 feet per second. Five SCFM of the oxygen would be injected through the inner tube 5 at a pressure of 100 to 150 psig with the remainder introduced through the outer tube 1 along with the air at a pressure at the entrance to the outer nozzle of about 3 to 5 psig. With these conditions, the pressure in the ore concentrate feed tube 3 will be maintained at about atmospheric pressure by the venturi of nozzle 7, and the jet of oxygen issuing from inner tube 5 will accelerate the ore concentrates to near that of the air and oxygen supplied through the outer tube 1. It is significant to note that with the subject burner, the amount of high pressure oxygen required is very low which reduces the cost of carrying out the process.

It is important to the proper operation of a flash burner that the proportion of oxygen to ore concentrates be kept a very constant, controllable ratio. This twin jet arrangement assures very smooth operation of the burner.

While specific practical embodiments of the invention have been disclosed, they are intended to be illustrative only and are not to be taken to limit the invention which is to be given the full scope of the appended claims and all equivalents thereof.

I claim:

1. A burner for use in the flash oxidation of metal concentrates comprising:

an outer, intermediate and inner tube each having a venturi nozzle on a first discharge end thereof;

means for mounting the intermediate tube concentrically within the outer tube with the nozzle on the discharge end of the intermediate tube partially extending into the nozzle on the discharge end of the outer tube;

means for mounting the inner tube concentrically within the intermediate tube with the nozzle on the discharge end of the inner tube partially extending into the nozzle on the discharge end of the intermediate tube;

first inlet means on the second end of the outer tube through which an oxidizing gas is introduced into the annular space between the intermediate and outer tubes at a first pressure;

second inlet means on the second end of the intermediate tube through which particles of metal concentrates are introduced in the annular space between the inner and the intermediate tubes; and third inlet means on the second end of the inner tube through which additional oxidizing gas is introduced at a second pressure greater than said first pressure, such that the particles of metal concentrate are injected into the oxidizing gas in the nozzle at the discharge end of the outer tube at high velocity by the additional oxidizing gas.

2. The burner of claim 1 wherein said means for mounting the intermediate tube concentrically within said outer tube includes means for adjusting the position of the intermediate tube axially relative to the outer tube to thereby adjust the extent to which the nozzle on the discharge end of the intermediate tube extends into the nozzle on the edge of the outer tube.

3. The burner of either claim 1 or 2 wherein said means for mounting the inner tube concentrically within the intermediate tube includes means for adjusting the position of the inner tube axially relative to the intermediate tube to thereby adjust the extent to which the inner tube extends into the nozzle on the end of the intermediate tube.

4. The burner of claim 1 including means for mounting said burner with the discharge ends of said tubes directed vertically downward.

5. The burner of claim 1 including a jacket surrounding said outer tube through which a fluid coolant can be circulated.

* * * * *